US007186675B2

(12) United States Patent
Meine et al.

(10) Patent No.: US 7,186,675 B2
(45) Date of Patent: Mar. 6, 2007

(54) QUICK DRYING WASHING AND CLEANING AGENT, COMPRISING AN ANIONIC/CATIONIC/AMPHOTERIC SURFACTANT MIXTURE

(75) Inventors: Georg Meine, Mettmann (DE); Brigitte Giesen, Duesseldorf (DE); Kerstin Ziganke, Duesseldorf (DE); Felix Mueller, Velbert (DE); Ralf Klein, Velbert (DE); Joerg Peggau, Essen (DE)

(73) Assignee: Henkel Kommanditgesellschaft auf Aktien (Henkel KGaA), Duesseldorf (DE)

( * ) Notice: Subject to any disclaimer, the term of this patent is extended or adjusted under 35 U.S.C. 154(b) by 213 days.

(21) Appl. No.: 10/380,312

(22) PCT Filed: Sep. 5, 2001

(86) PCT No.: PCT/EP01/10214

§ 371 (c)(1),
(2), (4) Date: Mar. 13, 2003

(87) PCT Pub. No.: WO02/22770

PCT Pub. Date: Mar. 21, 2002

(65) Prior Publication Data

US 2003/0171247 A1 Sep. 11, 2003

(30) Foreign Application Priority Data

Sep. 13, 2000 (DE) ..... 100 45 289

(51) Int. Cl.
*C11D 1/94* (2006.01)
*C11D 1/65* (2006.01)

(52) U.S. Cl. ..... 510/237; 510/235; 510/238; 510/243; 510/245; 510/254; 510/259; 510/362; 510/363; 510/365; 510/426; 510/427; 510/428; 510/490; 510/504

(58) Field of Classification Search ..... 510/235, 510/237, 238, 245, 243, 254, 259, 362, 363, 510/365, 426, 427, 428, 490, 504
See application file for complete search history.

(56) References Cited

U.S. PATENT DOCUMENTS

| | | | | |
|---|---|---|---|---|
| 4,235,759 | A | 11/1980 | Ohbu et al. | |
| 4,264,457 | A | 4/1981 | Beeks et al. | |
| 4,272,395 | A | 6/1981 | Wright | |
| 5,415,801 | A * | 5/1995 | Ofosu-Asante | 510/235 |
| 5,415,812 | A * | 5/1995 | Durbut et al. | 510/365 |
| 5,714,446 | A * | 2/1998 | Bartz et al. | 510/119 |
| 5,747,436 | A * | 5/1998 | Patel et al. | 510/124 |
| 5,904,735 | A * | 5/1999 | Gutierrez et al. | 8/137 |
| 5,962,388 | A | 10/1999 | Sherry et al. | |
| 5,994,285 | A * | 11/1999 | Sachdev et al. | 510/329 |
| 6,133,227 | A * | 10/2000 | Barnabas et al. | 510/530 |
| 6,136,769 | A | 10/2000 | Asano et al. | |
| 6,150,320 | A * | 11/2000 | McDonell et al. | 510/407 |
| 6,235,696 | B1 | 5/2001 | Hensen et al. | |
| 6,284,230 | B1 * | 9/2001 | Sako et al. | 424/70.11 |
| 6,334,452 | B1 * | 1/2002 | Tartakovsky et al. | 134/25.2 |
| 6,440,911 | B1 * | 8/2002 | Bettiol et al. | 510/137 |

FOREIGN PATENT DOCUMENTS

| | | | |
|---|---|---|---|
| DE | 198 13 059 | A1 | 9/1999 |
| GB | 1 518 067 | | 7/1978 |
| GB | 2 334 723 | A | 9/1999 |
| WO | WO 95/29217 | | 11/1995 |
| WO | 96/12000 | * | 4/1996 |
| WO | WO 96/12000 | A1 | 4/1996 |
| WO | WO 96/18717 | A1 | 6/1996 |
| WO | WO 97/00609 | A1 | 1/1997 |
| WO | 97/43388 | * | 11/1997 |
| WO | WO 97/43388 | A2 | 11/1997 |

OTHER PUBLICATIONS

International Cosmetic Ingredient Dictionary and Handbook, 7th Edition, The Cosmetic, Toiletry and Fragrance Association (CTFA), (1997).

Domsch et al., Anionic surfactants: organic chemistry, H.W. Stache, Surfactant Series, vol. 58, Marcel, Dekker, Inc., New York, pp. 501-549 (1996).

K. H. Wallhauber, "Praxis der Sterlisation, Desinfektion-Konservierung: Keimidentifizierung-Betriebshygiene", 5th Edition, Stugart, New York, Thieme (1995).

* cited by examiner

*Primary Examiner*—Charles Boyer
(74) *Attorney, Agent, or Firm*—John S. Child, Jr.; Glenn E.J. Murphy

(57) ABSTRACT

Surfactant combinations containing:
(a) one or more alkyl ether sulfates;
(b) at least one quaternary ammonium compound corresponding to formula I:

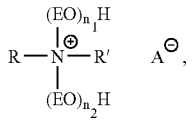

in which EO is ethylene oxide, R and R' are the same or different and represent alkyl groups, $n_1$ is 0–30 $n_2$ is 0–30, and A is a counterion;
(c) 0 to 50% of one or more alkyl and/or aryl sulfonates;
(d) 0 to 15% of one or more alkyl sulfates; and
(e) 0 to 20% of one or more amphoteric surfactants, and water-based cleaning composition containing such surfactant combinations.

17 Claims, No Drawings

QUICK DRYING WASHING AND CLEANING AGENT, COMPRISING AN ANIONIC/CATIONIC/AMPHOTERIC SURFACTANT MIXTURE

CROSS-REFERENCE TO RELATED APPLICATIONS

This application is a U.S. National Stage application filed under 35 U.S.C. §371, claiming priority under 35 U.S.C. §365 of International Application No. PCT/EP01/10214, filed Sep. 5, 2001 in the European Patent Office, and claiming priority under 35 U.S.C. §119 of DE 100 45 289.2, filed Sep. 13, 2000 in the German Patent Office.

BACKGROUND OF THE INVENTION

This invention relates to an aqueous surfactant-containing composition for cleaning hard surfaces, particularly tableware.

After manual moist or wet cleaning of hard surfaces in the home and in the institutional sector with a water-based surfactant-containing solution, the moist or wet hard surfaces are either simply left to dry or are dried in an additional step, normally with an absorbent cloth. Leaving the surfaces to dry is less labor-intensive, but lasts longer and, in the case of shining (mirroring reflective) hard surfaces, for example of glass, china, ceramic, plastic or metal, regularly leads to the formation of unwanted visible residues, such as stains (water stains) or streaks, and to a loss of shine, i.e. a dull appearance. This applies in particular to the manual cleaning of tableware, more particularly glasses and other items of glass tableware, when the tableware is first cleaned in a wash liquor—an aqueous solution of a surfactant-containing detergent, normally at an elevated temperature of, for example, about 45° C.—and is then left to dry in air, i.e. is not dried off with an absorbent cloth. When a cleaned glass or plate is removed from the wash liquor, the wash liquor is first poured out or off and the glass or plate is left on a draining board to dry. The layer of wash liquor remaining on the surface of the glass or plate drains off slowly until, finally, it becomes so thin that it no longer drains off, but only diminishes by (self) drying. Drying also takes place during drainage.

International patent application WO 96/18717 A1 (Colgate-Palmolive Company) discloses a skin-friendly liquid water-based cleaning composition for hard surfaces in the form of a clear microemulsion which effectively removes fatty and bath soil, leaves a sparkling appearance behind on unrinsed surfaces and contains 14 to 24% by weight of an alkali metal salt of a $C_{12-18}$ paraffin sulfonate, 2 to 6% by weight of an alkali metal salt of an ethoxylated $C_{12-18}$ alkyl ether sulfate and 2 to 8% by weight of a betaine surfactant and a nonionic surfactant, at least one solubilizer, a co-surfactant and a water-insoluble hydrocarbon, a perfume or an essential oil. A disadvantage of such compositions is their unfavorable drying behavior.

Accordingly, there was a need to provide quick-drying, surfactant-containing compositions for cleaning hard surfaces which would show improved drying and shine behavior.

DESCRIPTION OF THE INVENTION

The problem addressed by the present invention was further clearly to improve the drying or drainage behavior of aqueous surfactant-containing solutions for cleaning hard surfaces and, more particularly, to accelerate drying or drainage.

According to the invention, the problem stated above is solved by a surfactant combination containing (a) one or more alkyl ether sulfates;

(b) at least one quaternary ammonium compound corresponding to formula I:

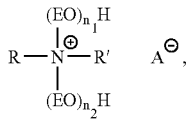

wherein EO is ethyleneoxide, R and R' are the same or different alkyl groups, $n_1$ is 0–30, $n_2$ is 0–30, and A is a counter-ion; and optionally (c) 0 to 50% of one or more alkyl and/or aryl sulfonates;

(d) 0 to 15% of one or more alkyl sulfates; and/or (e) 0 to 20% of one or more amphoteric surfactants.

According to the invention, the surfactant combination may be part of a water-based liquid composition.

Accordingly, in a second embodiment, the present invention relates to an aqueous liquid composition containing (a) one or more alkyl ether sulfates;

(b) at least one quaternary quaternary ammonium compound corresponding to formula I; and optionally (c) 0 to 50% of one or more alkyl and/or aryl sulfonates;

(d) 0 to 15% of one or more alkyl sulfates; and/or (e) 0 to 20% of one or more amphoteric surfactants.

It has surprisingly been found that the addition of quaternary ammonium salts corresponding to formula I to surfactant combinations or corresponding compositions contributes considerably towards improving drying and drainage behavior for the same cleaning performance. It would seem that an otherwise often unwanted interaction of the quaternary ammonium salt of formula I with the anionic surfactants plays a part in this regard. A complex is presumably formed between these two components which in the case of these special quaternary ammonium compounds, leads to particularly high surface activity.

The composition according to the invention is suitable for cleaning hard surfaces and, more particularly, as a hand dishwashing detergent (detergent for short). The amphoteric surfactants and particularly the alkyl ether sulfates contribute primarily to the cleaning effect. Besides the alkyl sulfonates, aryl sulfonates and/or alkyl sulfates, the at least one quaternary ammonium compound corresponding to formula I has an extremely positive effect on drying or drainage behavior, i.e. in particular clearly increases the drying rate and reduces residue formation.

The present invention also relates to the use of a composition according to the invention for cleaning hard surfaces, more particularly tableware. The composition according to the invention is preferably used for the manual cleaning of hard surfaces, more particularly for the manual cleaning of tableware. Besides tableware, hard surfaces in the context of the invention also include all other hard surfaces, more particularly of glass, ceramic, plastic or metal, in the home and in the institutional sector. The main advantage of the surfactant combination according to the invention, the composition according to the invention and the use according to the invention is the clear improvement in drying or drainage behavior produced by the at least one quaternary ammonium compound corresponding to formula I, more particularly the high drying rate or rather short drying time, the high drainage rate or rather short drainage time, as well as the minimal residue formation and the retention of shine. By drying is meant both drying as a whole, more particularly until no moisture can be seen or felt on the surface, and in particular drying after drainage.

Another advantage of the surfactant combination according to the invention, the composition according to the invention and the use according to the invention lies in the high cleaning performance (synonyms: cleaning effect, dishwashing performance), particularly against fatty soils.

Another advantage of the surfactant combination according to the invention or the composition according to the invention is its high storage stability.

In the context of the present invention, fatty acids and fatty alcohols or derivatives thereof—unless otherwise stated—stand for branched or unbranched carboxylic acids and alcohols or derivatives thereof preferably containing 5 to 26 carbon atoms. By virtue above all of their vegetable basis, the former are ecologically preferred in that they are based on renewable raw materials although the teaching according to the invention is by no means limited to them. In particular, the oxo alcohols obtainable, for example, by Roelen's oxo synthesis and their derivatives may also be used. Other suitable alcohols are Lial® types and the lightly branched Neodol® types (Shell Corp.). By fatty acid alkyl or tallow alkyl groups are meant the alkyl groups derived by hydrogenation from the particular acid.

Whenever alkaline earth metals are mentioned in the following as counterions for monovalent anions, this means that the alkaline earth metal is of course only present in half the quantity of the anion, which is sufficient for charge compensation.

Substances which also serve as ingredients of cosmetic preparations may be referred to in the following by their names under the INCI nomenclature (INCI=*International Nomenclature of Cosmetic Ingredients*). Chemical compounds bear an INCI name in English while vegetable ingredients are all referred to by their Latin names according to Linné, so-called trivial names such as "water", "honey" or "sea salt" also being shown in Latin. The INCI names can be found in the International Cosmetic Ingredient Dictionary and Handbook—7th Edition (1997) which is published by the Cosmetic, Toiletry and Fragrance Association (CTFA), 1101 17th Street, NW, Suite 300, Washington, D.C. 20036, USA and which contains more than 9,000 INCI names and references to more than 37,000 commercial names and technical names, including the associated distributors from more than 31 countries. The *International Cosmetic Ingredient Dictionary and Handbook* assigns the ingredients to one or more chemical classes, for example *Polymeric Ethers*, and one or more functions, for example *Surfactants—Cleansing Agents*, which in turn are explained in detail and to which reference may also be made in the following.

The initials CAS mean that the following sequence of digits is a reference number of the Chemical Abstracts Service.

Unless otherwise specifically indicated, quantities expressed as percentages by weight (% by weight) are based on the surfactant combination or composition as a whole.

Quaternary Ammonium Salts

The at least one quaternary ammonium salt used in the present invention corresponds to formula I:

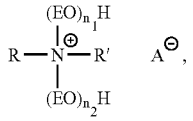

in which EO=ethylene oxide, R and R' represent identical or different alkyl groups and $n_1$=0–30 and $n_2$=0–30, A being a counterion. R may be a ($C_{5-26}$) alkyl group, preferably a ($C_{12-22}$) tallow alkyl group and more preferably a ($C_{16-18}$) tallow alkyl group. $R^1$ may be a ($C_{1-10}$) alkyl group, more particularly ethyl. $n_1$ and $n_2$ may assume identical or non-identical values in the range from 0 to 30, preferably in the range from 1 to 20, more preferably in the range from 1 to 16 and most preferably in the range from 1 to 8. For example, they may assume values of, in particular, 10, 12 and/or 14. The counterion A is a single negative charge anion, preferably from the group consisting of chloride, bromide, iodide, hydroxide, hydrogen sulfate, hydrogen carbonate, dihydrogen phosphate, thiocyanate, aryl sulfate and ($C_{1-5}$) alkyl sulfate, and is preferably methyl sulfate or ethyl sulfate and, more preferably, ethyl sulfate.

Suitable substituents R are odd-numbered and even-numbered, saturated and unsaturated, unbranched and branched alkyl groups, more particularly fatty acid alkyl groups, for example caproic acid alkyl, caprylic acid alkyl, capric acid alkyl, lauric acid alkyl, myristic acid alkyl, palmitic acid alkyl, stearic acid alkyl, arachic acid alkyl, behenic acid alkyl, lignoceric acid alkyl, cerotic acid alkyl, valeric acid alkyl, oenanthic acid alkyl, pelargonic acid alkyl, pentadecanoic acid alkyl, margaric acid alkyl, pristanoic acid alkyl, phytanoic acid alkyl, oleic acid alkyl, erucic acid alkyl, nervonic acid alkyl, linoleic acid alkyl, linolenic acid alkyl, arachidonic acid alkyl, eicosapentaenoic acid alkyl, dicosahenoic acid alkyl, oleic acid alkyl, palmitoleic acid alkyl, myristoleic acid alkyl, elaidic acid alkyl, linolelaidic acid alkyl, elaeostearic acid alkyl or parinaric acid alkyl.

The substituent R' may be a branched or unbranched alkyl group such as, for example, decyl, nonyl, octyl, n-heptyl, (1-6-)methylheptyl, n-hexyl, (1-5-)methylhexyl, n-pentyl, isopentyl, neopentyl, 1-methylpentyl, 2-methylpentyl, 3-methylpentyl, 4-methylpentyl, 1-ethylpentyl, 2-ethylpentyl, 3-ethylpentyl, 1-propylpentyl, n-butyl, sek.-butyl, isobutyl, tert.-butyl, 2,2-dimethylbutyl, 3,3-dimethylbutyl, 2,3-dimethylbutyl, 2-ethylbutyl, n-propyl, isopropyl and, more particularly, ethyl.

The two ethoxylated groups may be selected, for example, from the following: 2-hydroxyethyl, ethyleneoxyhydroxyethyl, diethyleneoxy-hydroxyethy, triethyleneoxyhydroxyethyl, tetraethyleneoxyhydroxyethyl, pentaethyleneoxyhydroxyethyl, hexaethyleneoxyhydroxyethyl, heptaethyleneoxyhydroxyethyl, octaethyleneoxyhydroxyethyl, nonaethyleneoxyhydroxyethyl, decaethyleneoxyhydroxyethyl, undecaethyleneoxyhydroxyethyl, dodecaethyleneoxyhydroxyethyl, tridecaethyleneoxyhydroxyethyl, tetradecaethyleneoxyhydroxyethyl, pentadecaethyleneoxyhydroxyethyl, hexadecaethyleneoxyhydroxyethyl, etc.

The quaternary ammonium compound tallowalkyl di(polyethoxyhydroxyethyl)-ethylammonium ethylsulfate (Adogen® 66) is particularly preferred.

The one or more quaternary ammonium salts corresponding to formula I are used in a quantity of 0.01 to 10% by weight, preferably in a quantity of 0.05 to 7% by weight, more preferably in a quantity of 0.05 to 5% by weight, most preferably in a quantity of 0.1 to 3% by weight and, in one most particularly preferred embodiment, in a quantity of 0.2 to 2% by weight.

Surfactants

The composition according to the invention contains surfactants in a total quantity of normally 0.5 to 60% by weight, preferably 1 to 55% by weight, more preferably 5 to 50% by weight, most preferably 10 to 45% by weight and, in one most particularly preferred embodiment, 15 to 40% by weight, for example 18, 25, 32 or 36% by weight.

Besides alkyl ether sulfates, alkyl and/or aryl sulfonates, alkyl sulfates and/or amphoteric surfactants, the composition according to the invention may additionally contain one or more other anionic surfactants, nonionic surfactants and/or cationic surfactants, especially to improve cleaning performance, drainage behavior and/or drying behavior.

The alkyl ether sulfates, alkyl and/or alkyl sulfonates and/or alkyl sulfates and the other anionic surfactants are normally used in the form of alkali metal, alkaline earth metal and/or mono-, di- or trialkanolammonium salts and/or in the form of the corresponding acids to be neutralized in situ with the corresponding alkali metal hydroxide, alkaline earth metal hydroxide and/or mono-, di or trialkanolamine. Preferred alkali metals are potassium and in particular sodium, preferred alkaline earth metals are calcium and in particular magnesium and preferred alkanolamines are mono-, di- or triethanolamine. The sodium salts are particularly preferred.

Alkyl Ether Sulfates

Alkyl ether sulfates (fatty alcohol ether sulfates, INCI Alkyl Ether Sulfates) are products of sulfation reactions on alkoxylated alcohols. Alkoxylated alcohols are generally understood by one of skill in the art to be the reaction products of alkylene oxide, preferably ethylene oxide, with alcohols—in the context of the invention preferably with relatively long-chain alcohols, i.e. with aliphatic straight-chain or single- or multiple-branch, acyclic or cyclic, saturated or mono- or polyunsaturated, preferably straight-chain, acyclic saturated alcohols containing 6 to 22, preferably 8 to 18, more preferably 10 to 16 and most preferably 12 to 14 carbon atoms. Depending on the reaction conditions, a complex mixture of addition products with different degrees of ethoxylation is generally formed from n moles ethylene oxide and one mole alcohol (n=1 to 30, preferably 0.3 to 20, more preferably 0.3 to 10 and most preferably 0.3 to 5). Another embodiment of the alkoxylation consists in using mixtures of the alkylene oxides, preferably a mixture of ethylene oxide and propylene oxide. Fatty alcohols with low degrees of ethoxylation, i.e. with 0.3 to 4 ethylene oxide units (EO), more particularly 0.3 to 20 EO, for example 0.5 EO, 1.0 EO, 1.3 EO, such as Na $C_{12-14}$ fatty alcohol+0.5 EO sulfate, Na $C_{12-14}$ fatty alcohol+1.3 EO sulfate, Na $C_{12-14}$ fatty alcohol+2.0 EO sulfate and/or Mg $C_{11-14}$ fatty alcohol+1.0 EO sulfate, are most particularly preferred for the purposes of the invention.

The composition according to the invention contains one or more alkyl ether sulfates in a quantity of—typically—1 to 50% by weight, preferably 3 to 40% by weight, more preferably more than 6 to 30% by weight, most preferably 8 to 20% by weight and, in one most particularly preferred embodiment, 10 to 16% by weight.

Alkyl and/or Aryl Sulfonates

The alkyl sulfonates (INCI Sulfonic Acids) normally contain an aliphatic, straight-chain or single- or multiple-branch, acyclic or cyclic, saturated or mono- or polyunsaturated, preferably branched, acyclic, saturated alkyl group containing 6 to 22, preferably 9 to 20, more preferably 11 to 18 and most preferably 13 to 17 carbon atoms.

Accordingly, suitable alkyl sulfonates are the saturated alkane sulfonates, the unsaturated olefin sulfonates and the ether sulfonates (formally derived from the alkoxylated alcohols on which the alkyl ether sulfates are also based) which are divided into terminal ester sulfonates (n-ether sulfonates) with the sulfonate function attached to the polyether chain and internal ester sulfonates (i-ester sulfonates) with the sulfonate function attached to the alkyl group According to the invention, the alkane sulfonates, more particularly alkane sulfonates with a branched, preferably secondary, alkyl group, for example the secondary alkanesulfonate sec. Na $C_{13-17}$ alkane sulfonate (INCI Sodium C14–17 Alkyl Sec Sulfonate), are preferred.

Preferred aryl sulfonates are alkyl benzenesulfonates, the alkyl groups being branched and unbranched chains with 1 to 20, preferably 2 to 18, more preferably 6 to 16 and most preferably 8 to 12 carbon atoms. Particularly preferred examples are linear alkyl benzenesulfonates (LAS) and/or cumemesulfonate.

The composition according to the invention contains one or more alkyl and/or aryl sulfonates in a quantity of—typically—0.1 to less than 50% by weight, preferably 0.1 to 30% by weight, more preferably 1 to less than 14% by weight, most preferably 2 to 10% by weight and, in one most particularly preferred embodiment, 4 to 8% by weight.

Alkyl Sulfates

Alkyl sulfates, such as fatty alcohol sulfates for example, may also be used in the present invention. Suitable alkyl sulfates are sulfates of saturated and unsaturated $C_{6-22}$, preferably $C_{10-16}$ and more preferably $C_{11-16}$ fatty alcohols. Particularly suitable alkyl sulfates are those with a native $C_{12-14-16}$ C cut and/or petrochemical $C_{12-13}$, $C_{14-15}$ C cut in the range from 0 to 15%, preferably 0 to 10%, more preferably 0 to 10% and most preferably 0 to 8%.

Amphoteric Surfactants

The amphoteric surfactants (zwitterionic surfactants) which may be used in accordance with the invention include betaines, alkyl amidoalkyl amines, alkyl-substituted amino acids, acylated amino acids and biosurfactants, of which the betaines are preferred for the purposes of the invention.

The composition according to the invention contains one or more amphoteric surfactants in a quantity of—typically—0.1 to 20% by weight, preferably 1 to 15% by weight, more preferably 2 to 12% by weight, most preferably 3 to 10% by weight and, in one most particularly preferred embodiment, 4 to 8% by weight.

Betaines

Suitable betaines are the alkyl betaines, the alkylamidobetaines, the imidazolinium betaines, the sulfobetaines (INCI Sultaines) and the phosphobetaines and preferably correspond to formula II:

$$R^1—[CO—X—(CH_2)_n]_x—N^+(R^2)(R^3)—(CH_2)_m—[CH(OH)—CH_2]_y—Y^- \quad (II)$$

in which $R^1$ is a saturated or unsaturated $C_{6-22}$ alkyl group, preferably a $C_{8-18}$ alkyl group and more preferably a saturated $C_{10-16}$ alkyl group, for example a saturated $C_{12-14}$ alkyl group, X is NH, $NR^4$ with the $C_{1-4}$ alkyl group $R^4$, O or S, n is a number of 1 to 10, preferably 2 to 5 and more preferably 3, x is 0 or 1, preferably 1, $R^2$ and $R^3$ independently of one another represent an optionally hydroxysubstituted $C_{1-4}$ alkyl group such as, for example, a hydroxyethyl group, but especially a methyl group, m is a number of 1 to 4, more particularly 1, 2 or 3, y is 0 or 1 and Y is COO, $SO_3$, $OPO(OR^5)O$ or $P(O)(OR^5)O$, where $R^5$ is a hydrogen atom H or a $C_{1-4}$ alkyl group.

The alkyl betaines and alkylamidobetaines corresponding to formula II with a carboxylate group ($Y^-$=$COO^-$), are also known as carbobetaines.

Preferred amphoteric surfactants are the alkyl betaines corresponding to formula (IIa), the alkylamidobetaines corresponding to formula (II), the sulfobetaines corresponding to formula (IIc) and the amidosulfobetaines corresponding to formula (IId):

$$R^1—N^+(CH_3)_2—CH_2COO^- \quad (IIa)$$

$$R^1—CO—NH—(CH_2)_3—N^+(CH_3)_2—CH_2COO^- \quad (IIb)$$

$$R^1—N^+(CH_3)_2—CH_2CH(OH)CH_2SO_3^- \quad (IIc)$$

$$R^1—CO—NH—(CH_2)_3—N^+(CH_3)_2—CH_2CH(OH)CH_2SO_3^- \quad (IId)$$

in which $R^1$ is as defined for formula 1.

Particularly preferred amphoteric surfactants are the carbobetaines and more particularly the carbobetaines corresponding to formulae (IIa) and (IIb), the alkylamidobetaines corresponding to formula (IIb) being most particularly preferred.

Examples of suitable betaines and sulfobetaines are the following compounds identified by their INCI names: Almondamidopropyl Betaine, Apricotamidopropyl Betaine, Avocadamidopropyl Betaine, Babassuamidopropyl Betaine, Behenamidopropyl Betaine, Behenyl Betaine, Betaine, Canolamidopropyl Betaine, Capryl/Capramidopropyl Betaine, Carnitine, Cetyl Betaine, Cocamidoethyl Betaine, Cocamidopropyl Betaine, Cocamidopropyl Hydroxysultaine, Coco-Betaine, Coco-Hydroxysultaine, Coco/Oleamidopropyl Betaine, Coco-Sultaine, Decyl Betaine, Dihydroxyethyl Oleyl Glycinate, Dihydroxyethyl Soy Glycinate, Dihydroxyethyl Stearyl Glycinate, Dihydroxyethyl Tallow Glycinate, Dimethicone Propyl PG-Betaine, Erucamidopropyl Hydroxysultaine, Hydrogenated Tallow Betaine, Isostearamidopropyl Betaine, Lauramido-propyl Betaine, Lauryl Betaine, Lauryl Hydroxysultaine, Lauryl Sultaine, Milkamidopropyl Betaine, Minkamidopropyl Betaine, Myristamidopropyl Betaine, Myristyl Betaine, Oleamidopropyl Betaine, Oleamidopropyl Hydroxysultaine, Oleyl Betaine, Olivamidopropyl Betaine, Palmamidopropyl Betaine, Palmitamidopropyl Betaine, Palmitoyl Carnitine, Palm Kernelamidopropyl Betaine, Polytetrafluoroethylene Acetoxypropyl Betaine, Ricinoleamidopropyl Betaine, Sesamidopropyl Betaine, Soyamidopropyl Betaine, Stearamidopropyl Betaine, Stearyl Betaine, Tallowamidopropyl Betaine, Tallowamidopropyl Hydroxysultaine, Tallow Betaine, Tallow Dihydroxyethyl Betaine, Undecylenamidopropyl Betaine and Wheat Germamidopropyl Betaine. A preferred betaine is, for example, Cocamidopropyl Betaine (Cocoamidopropylbetaine).

Alkylamido Alkylamines

The alkylamido alkylamines (INCI Alkylamido Alkylamines) are amphoteric surfactants corresponding to formula (III):

$$R^9—CO—NR^{10}—(CH_2)_i—N(R^{11})—(CH_2CH_2O)_j—(CH_2)_k—[CH(OH)]_l—CH_2—Z\text{-}OM \quad (III)$$

in which $R^9$ is a saturated or unsaturated $C_{6-22}$ alkyl group, preferably a $C_{8-18}$ alkyl group and more preferably a saturated $C_{10-16}$ alkyl group, for example a saturated $C_{12-14}$ alkyl group, $R^{10}$ is a hydrogen atom H or a $C_{1-4}$ alkyl group, preferably H, i is a number of 1 to 10, preferably 2 to 5, more preferably 2 or 3, $R^{11}$ is a hydrogen atom H or $CH_2COOM$ (for M, see below), j is a number of 1 to 4, preferably 1 or 2, more preferably 1, k is a number of 0 to 4, preferably 0 or 1, l is 0 or 1, k being 1 where l is 1, Z is CO, $SO_2$, $OPO(OR^{12})$ or $P(O)(OR^{12})$ where $R^{12}$ is a $C_{1-4}$ alkyl group or M (see below) and M is a hydrogen atom, an alkali metal, an alkaline earth metal or a protonated alkanolamine, for example protonated mono-, di- or triethanolamine.

Preferred representatives correspond to formulae IIIa to IIId:

$$R^9—CO—NH—(CH_2)_2—N(R^{11})—CH_2CH_2O—CH_2—COOM \quad (IIIa)$$

$$R^9—CO—NH—(CH_2)_2—N(R^{11})—CH_2CH_2O—CH_2CH_2—COOM \quad (IIIb)$$

$$R^9—CO—NH—(CH_2)_2—N(R^{11})—CH_2CH_2O—CH_2CH(OH)CH_2—SO_3M \quad (IIIc)$$

$$R^9—CO—NH—(CH_2)_2—N(R^{11})—CH_2CH_2O—CH_2CH(OH)CH_2—OPO_3HM \quad (IIId)$$

in which $R^{11}$ and M are as defined for formula (III).

Examples of alkylamido alkylamines are the following compounds identified by their INCI names: Cocoamphodipropionic Acid, Cocobetainamido Amphopropionate, DEA-Cocoamphodipropionate, Disodium Caproamphodiacetate, Disodium Caproamphodipropionate, Disodium Capryloamphodiacetate, Disodium Capryloamphodipropionate, Disodium Cocoamphocarboxyethylhydroxypropylsulfonate, Disodium Cocoamphodiacetate, Disodium Cocoamphodipropionate, Disodium Isostearoamphodiacetate, Disodium Isostearoamphodipropionate, Disodium Laureth-5 Carboxyamphodiacetate, Disodium Lauroamphodiacetate, Disodium Lauroamphodipropionate, Disodium Oleoamphodipropionate, Disodium PPG-2-Isodeceth-7 Carboxyamphodiacetate, Disodium Stearoamphodiacetate, Disodium Tallowamphodiacetate, Disodium Wheatgermamphodiacetate, Lauroamphodipropionic Acid, Quaternium-85, Sodium Caproamphoacetate, Sodium Caproamphohydroxypropylsulfonate, Sodium Caproamphopropionate, Sodium Capryloamphoacetate, Sodium Capryloamphohydroxypropylsulfonate, Sodium Capryloamphopropionate, Sodium Cocoamphoacetate, Sodium Cocoamphohydroxypropylsulfonate, Sodium Cocoamphopropionate, Sodium Cornamphopropionate, Sodium Isostearoamphoacetate, Sodium Isostearoamphopropionate, Sodium Lauroamphoacetate, Sodium Lauroamphohydroxypropylsulfonate, Sodium Lauroampho PG-Acetate Phosphate, Sodium Lauroamphopropionate, Sodium Myristoamphoacetate, Sodium Oleoamphoacetate, Sodium Oleoamphohydroxypropylsulfonate, Sodium Oleoamphopropionate, Sodium Ricinoleoamphoacetate, Sodium Stearoamphoacetate, Sodium Stearoamphohydroxypropylsulfonate, Sodium Stearoamphopropionate, Sodium Tallamphopropionate, Sodium Tallowamphoacetate, Sodium Undecylenoamphoacetate, Sodium Undecylenoamphopropionate, Sodium Wheat Germ amphoacetate and Trisodium Lauroampho PG-Acetate Chloride Phosphate.

Alkyl-Substituted Amino Acids

According to the invention, preferred alkyl-substituted amino acids (INCI Alkyl-Substituted Amino Acids) are monoalkyl-substituted amino acids corresponding to formula (IV):

$$R^{13}—NH—CH(R^{14})—(CH_2)_u—COOM' \quad (IV)$$

in which $R^{13}$ is a saturated or unsaturated $C_{6-22}$ alkyl group, preferably a $C_{8-18}$ alkyl group and more preferably a saturated $C_{10-16}$ alkyl group, for example a saturated $C_{12-14}$ alkyl group, $R^{14}$ is a hydrogen atom H or a $C_{1-4}$ alkyl group, preferably H, u is a number of 0 to 4, preferably 0 or 1, more preferably 1, and M' is a hydrogen atom, an alkali metal, an alkaline earth metal or a protonated alkanolamine, for example protonated mono-, di- or triethanolamine, alkyl-substituted imino acids corresponding to formula (V):

$$R^{15}—N—[(CH_2)_v—COO\ M'']_2 \quad (V)$$

in which $R^{15}$ is a saturated or unsaturated $C_{6-22}$ alkyl group, preferably a $C_{8-18}$ alkyl group and more preferably a saturated $C_{10-16}$ alkyl group, for example a saturated $C_{12-14}$ alkyl group, v is a number of 1 to 5, preferably 2 or 3, more preferably 2, and M" is a hydrogen atom, an alkali metal, an alkaline earth metal or a protonated alkanolamine, for example protonated mono-, di- or triethanolamine; M" in the two carboxy groups may have the same meaning or two different meanings, for example may be hydrogen and sodium or just sodium, and mono- or dialkyl-substituted natural amino acids corresponding to formula (VI):

$$R^{16}—N(R^{17})—CH(R^{18})—COOM''' \quad (VI)$$

in which $R^{16}$ is a saturated or unsaturated $C_{6-22}$ alkyl group, preferably a $C_{8-18}$ alkyl group and more preferably a saturated $C_{10-16}$ alkyl group, for example a saturated $C_{12-14}$ alkyl group, $R^{17}$ is a hydrogen atom or an optionally hydroxy- or amine-substituted $C_{1-4}$ alkyl group, for example a methyl, ethyl, hydroxyethyl or aminopropyl group, $R^{18}$ is the residue of one of the 20 natural α-amino acids $H_2NCH(R^{18})COOH$ and M''' is a hydrogen atom, an alkali metal, an alkaline earth metal or a protonated alkanolamine, for example protonated mono-, di- or triethanolamine.

Particularly preferred alkyl-substituted amino acids are the aminopropionates corresponding to formula (IVa):

$$R^{13}—NH—CH_2CH_2COOM' \quad (IVa)$$

in which $R^{13}$ and M' have the same meanings as in formula (IV).

Examples of alkyl-substituted amino acids are the following compounds identified by their INCI names: Aminopropyl Laurylglutamine, Cocaminobutyric Acid, Cocaminopropionic Acid, DEA-Lauraminopropionate, Disodium Cocaminopropyl Iminodiacetate, Disodium Dicarboxyethyl Cocopropylenediamine, Disodium Lauriminodipropionate, Disodium Steariminodipropionate, Disodium Tallowiminodipropionate, Lauraminopropionic Acid, Lauryl Aminopropylglycine, Lauryl Diethylenediaminoglycine, Myristaminopropionic Acid, Sodium C12–15 Alkoxypropyl Iminodipropionate, Sodium Cocaminopropionate, Sodium Lauraminopropionate, Sodium Lauriminodipropionate, Sodium Lauroyl Methylaminopropionate, TEA-Lauraminopropionate and TEA-Myristamino-propionate.

Acylated Amino Acids

Acylated amino acids are amino acids, more particularly the 20 natural α-amino acids, which carry the acyl group $R^{19}CO$ of a saturated or unsaturated fatty acid $R^{19}COOH$ at the amino nitrogen atom ($R^{19}$ being a saturated or unsaturated $C_{6-22}$ alkyl group, preferably a $C_{8-18}$ alkyl group and more preferably a saturated $C_{10-16}$ alkyl group, for example a saturated $C_{12-14}$ alkyl group). The acylated amino acids may also be used in the form of an alkali metal salt, an alkaline earth metal salt or alkanolammonium salt, for example mono-, di- or triethanolamine. Examples of acylated amino acids are the acyl derivatives known collectively by the INCI name of Amino Acids, for example Sodium Cocoyl Glutamate, Lauroyl Glutamic Acid, Capryloyl Glycine or Myristoyl Methylalanine.

Amphoteric Surfactant Combinations

One particular embodiment of the invention is characterized by the use of two or more different amphoteric surfactants, more particularly a combination of binary amphoteric surfactants.

The combination of amphoteric surfactants preferably contains at least one betaine, more particularly at least one alkylamidobetaine and most preferably cocoamidopropylbetaine.

In addition, the combination of amphoteric surfactants preferably contains at least one amphoteric surfactant from the group consisting of sodium carboxyethyl cocophosphoethylimidazoline (Phosphoteric® TC-6), $C_{8/10}$-amidopropyl betaine (INCI Capryl/Capramidopropyl Betaine; Tego® Betaine 810), N-2-hydroxyethyl-N-carboxymethyl fatty acid amidoethylamine Na(Rewoteric® AMV) and N-capryl/capramidoethyl-N-ethylether propionate Na(Rewoteric® AMVSF) and the betaine 3-(3-cocoamido-propyl)-dimethylammonium-2-hydroxypropanesulfonat (INCI Sultaine; Rewoteric® AM CAS) and the alkylamidoalkylamine N-[N'(N"-2-hydroxyethyl-N"-carboxyethylaminoethyl)-acetic acid amido]-N,N-dimethyl-N-cocoammoniumbetaine (Rewoteric® QAM 50), more particularly together with cocoamidopropylbetaine.

In another particular embodiment, the composition according to the invention contains one or more amphoteric surfactants in a quantity of more than 8% by weight. In yet another particular embodiment, the composition according to the invention contains one or more amphoteric surfactants in a quantity of less than 2% by weight.

Other Anionic Surfactants

The composition according to the invention may additionally contain one or more other anionic surfactants in a quantity of—typically—0.001 to 5% by weight, preferably 0.01 to 4% by weight, more preferably 0.1 to 3% by weight, most preferably 0.2 to 2% by weight and, in one most particularly preferred embodiment, 0.5 to 1.5% by weight, for example 1% by weight.

Suitable other anionic surfactants are, in particular, aliphatic sulfates, such as fatty alcohol sulfates, monoglyceride sulfates and ester sulfonates (sulfofatty acid esters), lignin sulfonates, alkyl benzene sulfonates, fatty acid cyanamides, anionic sulfosuccinic acid surfactants, fatty acid isethionates, acylaminoalkane sulfonates (fatty acid taurides), fatty acid sarcosinates, ether carboxylic acids and alkyl (ether) phosphates.

Suitable other anionic surfactants also include anionic gemini surfactants with a diphenyl oxide basic structure, two sulfonate groups and an alkyl group on one or both benzene rings corresponding to the formula $$^{-}O_3S(C_6H_3R)O(C_6H_3R')SO_3^{-}$$

in which R is an alkyl group containing, for example, 6, 10, 12 or 16 carbon atoms and R' stands for R or H (Dowfax® Dry Hydrotrope Powder containing $C_{16}$ alkyl group(s); INCI Sodium Hexyldiphenyl Ether Sulfonate, Disodium Decyl Phenyl Ether Disulfonate, Disodium Lauryl Phenyl Ether Disulfonate, Disodium Cetyl Phenyl Ether Disulfonate) and fluorinated anionic surfactants, more particularly perfluorinated alkyl sulfonates, such as ammonium $C_{9/10}$ perfluoroalkyl sulfonate (Fluorad® FC 120) and perfluoro-octane sulfonic acid potassium salt (Fluorad® FC 95).

Anionic Sulfosuccinic Acid Surfactants

Particularly preferred other anionic surfactants are the anionic sulfosuccinic acid surfactants sulfosuccinates, sulfosuccinamates and sulfosuccinamides, more particularly sulfosuccinates and sulfosuccinamates and most preferably sulfosuccinates. The sulfosuccinates are the salts of the mono- and diesters of sulfosuccinic acid $HOOCCH(SO_3H)CH_2COOH$ while the sulfosuccinamates are understood to be the salts of the monoamides of sulfosuccinic acid and the sulfosuccinamides are understood to be the salts of the diamides of sulfosuccinic acid. A detailed description of these known anionic surfactants is provided by A. Domsch and B. Irrgang in Anionic Surfactants: Organic Chemistry (edited by H. W. Stache; Surfactant Science Series; Volume 56; ISBN 0-8247-9394-2; Marcel Dekker, Inc., New York 1996, pages 501–549).

The salts are preferably alkali metal salts, ammonium salts and mono-, di- and trialkanolammonium salts, for example mono-, di- and triethanolammonium salts, more particularly lithium, sodium, potassium and ammonium salts, more preferably sodium and ammonium salts and most preferably sodium salts.

In the sulfosuccinates, one or both carboxyl groups of the sulfosuccinic acid is/are preferably esterified with one or two identical or different unbranched, branched, saturated or unsaturated, acyclic or cyclic, optionally alkoxylated alcohols containing 4 to 22, preferably 6 to 20, more preferably 8 to 18, most preferably 10 to 16 and, in one most particularly preferred embodiment, 12 to 14 carbon atoms. Particular preference is attributed to the esters of unbranched and/or saturated and/or acyclic and/or alkoxylated alcohols, more particularly unbranched saturated fatty alcohols and/or unbranched saturated fatty alcohols alkoxylated with ethylene and/or propylene oxide, preferably ethylene oxide, with a degree of alkoxylation of 1 to 20, preferably 1 to 15, more preferably 1 to 10, most preferably 1 to 6 and, in one most particularly preferred embodiment, 1 to 4. According to the invention, the monoesters are preferred to the diesters. A particularly preferred sulfosuccinate is sulfosuccinic acid lauryl polyglycol ester disodium salt (lauryl-EO-sulfosuccinate, disodium salt, INCI Disodium Laureth Sulfosuccinate) which is commercially obtainable, for example, as Tego® Sulfosuccinat F30 (Goldschmidt) with a sulfosuccinate content of 30% by weight.

In the sulfosuccinamates or sulfosuccinamides, one or both carboxyl groups of the sulfosuccinic acid preferably form a carboxylic acid amide with a primary or secondary amine which carries one or two identical or different, unbranched or branched, saturated or unsaturated, acyclic or cyclic, optionally alkoxylated alkyl groups containing 4 to 22, preferably 6 to 20, more preferably 8 to 18, most preferably 10 to 16 and, in one most particularly preferred embodiment, 12 to 14 carbon atoms. Unbranched and/or saturated and/or acyclic alkyl groups, more particularly unbranched saturated fatty alkyl groups, are particularly preferred.

Also suitable are, for example, the following sulfosuccinates and sulfosuccinamates referred to by their INCI names which are described in more detail in *International Cosmetic Ingredient Dictionary and Handbook*: Ammonium Dinonyl Sulfosuccinate, Ammonium Lauryl Sulfosuccinate, Diammonium Dimethicone Copolyol Sulfosuccinate, Diammonium Lauramido-MEA Sulfosuccinate, Diammonium Lauryl Sulfosuccinate, Diammonium Oleamido PEG-2 Sulfosuccinate, Diamyl Sodium Sulfosuccinate, Dicapryl Sodium Sulfosuccinate, Dicyclohexyl Sodium Sulfosuccinate, Diheptyl Sodium Sulfosuccinate, Dihexyl Sodium Sulfosuccinate, Diisobutyl Sodium Sulfosuccinate, Dioctyl Sodium Sulfosuccinate, Disodium Cetearyl Sulfosuccinate, Disodium Cocamido MEA-Sulfosuccinate, Disodium Cocamido MIPA-Sulfosuccinate, Disodium Cocamido PEG-3 Sulfosuccinate, Disodium Coco-Glucoside Sulfosuccinate, Disodium Cocoyl Butyl Gluceth-10 Sulfosuccinate, Disodium C12–15 Pareth Sulfosuccinate, Disodium Deceth-5 Sulfosuccinate, Disodium Deceth-6 Sulfosuccinate, Disodium Dihydroxyethyl Sulfosuccinylundecylenate, Disodium Dimethicone Copolyol Sulfosuccinate, Disodium Hydrogenated Cottonseed Glyceride Sulfosuccinate, Disodium Isodecyl Sulfosuccinate, Disodium Isostearamido MEA-Sulfosuccinate, Disodium Isostearamido MIPA-Sulfosuccinate, Disodium Isostearyl Sulfosuccinate, Disodium Laneth-5 Sulfosuccinate, Disodium Lauramido MEA-Sulfosuccinate, Disodium Lauramido PEG-2 Sulfosuccinate, Disodium Lauramido PEG-5 Sulfosuccinate, Disodium Laureth-6 Sulfosuccinate, Disodium Laureth-9 Sulfosuccinate, Disodium Laureth-12 Sulfosuccinate, Disodium Lauryl Sulfosuccinate, Disodium Myristamido MEA-Sulfosuccinate, Disodium Nonoxynol-10 Sulfosuccinate, Disodium Oleamido MEA-Sulfosuccinate, Disodium Oleamido MIPA-Sulfosuccinate, Disodium Oleamido PEG-2 Sulfosuccinate, Disodium Oleth-3 Sulfosuccinate, Disodium Oleyl Sulfosuccinate, Disodium Palmitamido PEG-2 Sulfosuccinate, Disodium Palmitoleamido PEG-2 Sulfosuccinate, Disodium PEG-4 Cocamido MIPA-Sulfosuccinate, Disodium PEG-5 Laurylcitrate Sulfosuccinate, Disodium PEG-8 Palm Glycerides Sulfosuccinate, Disodium Ricinoleamido MEA-Sulfosuccinate, Disodium Sitostereth-14 Sulfosuccinate, Disodium Stearamido MEA-Sulfosuccinate, Disodium Stearyl Sulfosuccinamate, Disodium Stearyl Sulfosuccinate, Disodium Tallamido MEA-Sulfosuccinate, Disodium Tallowamido MEA-Sulfosuccinate, Disodium Tallow Sulfosuccinamate, Disodium Tridecylsulfosuccinate, Disodium Undecylenamido MEA-Sulfosuccinate, Disodium Undecylenamido PEG-2 Sulfosuccinate, Disodium Wheat Germamido MEA-Sulfosuccinate, Disodium Wheat Germamido PEG-2 Sulfosuccinate, Di-TEA-Oleamido PEG-2 Sulfosuccinate, Ditridecyl Sodium Sulfosuccinate, Sodium Bisglycol Ricinosulfosuccinate, Sodium/MEA Laureth-2 Sulfosuccinate and Tetrasodium Dicarboxyethyl Stearyl Sulfosuccinamate. Another suitable sulfosuccinamate is disodium-$C_{16-18}$-alkoxypropylene sulfosuccinamate.

Preferred anionic sulfosuccinic acid surfactants are imidosuccinate, mono-Na-sulfosuccinic acid diisobutyl ester (Monawet® MB 45), mono-Na-sulfosuccinic acid dioctyl ester (Monawet® MO-84 R2W, Rewopol® SB DO 75), mono-Na-sulfosuccinic acid di-tridecyl ester (Monawet® MT 70), fatty alcohol polyglycol sulfosuccinate-Na—$NH_4$ salt (sulfosuccinate, S-2), di-Na-sulfosuccinic acid mono-$C_{12-14}$-3EO ester (Texapon® SB-3), sodium sulfosuccinic acid diisooctyl ester (Texin® DOS 75) and di-Na-sulfosuccinic acid mono-$C_{12/18}$ester (Texin® 128-P), more particularly the mono-Na-sulfosuccinic acid dioctyl ester synergistically co-operating with the ternary surfactant combination according to the invention with regard to drainage and/or drying behavior.

In one particular embodiment, the composition according to the invention contains one or more sulfosuccinates, sulfosuccinamates and/or sulfosuccinamides, preferably sulfosuccinates and/or sulfosuccinamates, more preferably sulfosuccinates, in a quantity of—typically—0.001 to 5% by weight, preferably 0.01 to 4% by weight, more preferably 0.1 to 3% by weight, most preferably 0.2 to 2% by weight and, in one most particularly preferred embodiment, 0.5 to 1.5% by weight, for example 1% by weight.

Nonionic Surfactants

The composition according to the invention may additionally contain one or more nonionic surfactants in a quantity of—typically—0.001 to 5% by weight, preferably 0.01 to 4% by weight, more preferably 0.1 to 3% by weight, most preferably 0.2 to 2% by weight and, in one most particularly preferred embodiment, 0.5 to 1.5% by weight, for example 1% by weight.

Nonionic surfactants in the context of the invention are alkoxylates, such as polyglycol ethers, fatty alcohol polyglycol ethers, alkyl phenol polyglycol ethers, end-capped polyglycol ethers, mixed ethers and hydroxy mixed ethers and fatty acid polyglycol esters. Block polymers of ethylene oxide and propylene oxide and fatty acid alkanolamides and fatty acid polyglycol ethers are also suitable. Important classes of nonionic surfactants according to the invention are also the amine oxides and the sugar surfactants, more particularly the alkyl polyglucosides.

Fatty Alcohol Polyglycol Ethers

In the context of the invention, fatty alcohol polyglycol ethers are unbranched or branched, saturated or unsaturated $C_{10-22}$ alcohols alkoxylated with ethylene oxide (EO) and/or propylene oxide (PO) with a degree of alkoxylation of up to 30, preferably ethoxylated $C_{10-18}$ fatty alcohols with a degree of ethoxylation of less than 30, preferably with a degree of ethoxylation of 1 to 20, more preferably 1 to 12, most preferably 1 to 8 and, in one most particularly preferred embodiment, 2 to 5, for example $C_{12-14}$ fatty alcohol ethoxylates with 2, 3 or 4 EO or a mixture of the $C_{12-14}$ fatty alcohol ethoxylates with 3 and 4 EO in a ratio by weight of 1 to 1 or isotridecyl alcohol ethoxylate with 5, 8 or 12 EO.

Amine Oxides

According to the invention, suitable amine oxides include alkyl amine oxides, more particularly alkyl dimethyl amine oxides, alkylamidoamine oxides and alkoxyalkyl amine oxides. Preferred amine oxides correspond to formula VII:

$$R^6R^7R^8N^+—O- \quad (VII)$$

$$R^6—[CO—NH—(CH_2)_w]_z—N^+(R^7)(R^8)—O^- \quad (VIIa)$$

$$R^6—[CO—NH—(CH_2)_z]—N^+(R^7)(R^8)—O^-$$

in which $R^6$ is a saturated or unsaturated $C_{6-22}$ alkyl group, preferably a $C_{8-18}$ alkyl group, more preferably a saturated $C_{10-16}$ alkyl group, for example a saturated $C_{12-14}$ alkyl group which, in the alkylamidoamine oxides (VIIa), is attached to the nitrogen atom via a carbonylamidoalkylene group —CO—NH—$(CH_2)_z$— and, in the alkoxyalkyl amine oxides, via an oxa-alkylene group —O—$(CH_2)_z$— where z is a number of 1 to 10, preferably 2 to 5 and more preferably 3, $R^7$ and $R^8$ independently of one another represent an optionally hydroxysubstituted $C_{1-4}$ alkyl group such as, for example, a hydroxyethyl group, more particularly a methyl group.

Examples of suitable amine oxides are the following compounds identified by their INCI names: Almondamidopropylamine Oxide, Babassuamidopropylamine Oxide, Behenamine Oxide, Cocamidopropyl Amine Oxide, Cocamidopropylamine Oxide, Cocamine Oxide, Coco-Morpholine Oxide, Decylamine Oxide, Decyltetradecylamine Oxide, Diaminopyrimidine Oxide, Dihydroxyethyl C8–10 Alkoxypropylamine Oxide, Dihydroxyethyl C9–11 Alkoxypropylamine Oxide, Dihydroxyethyl C12–15 Alkoxypropylamine Oxide, Dihydroxyethyl Cocamine Oxide, Dihydroxyethyl Lauramine Oxide, Dihydroxyethyl Stearamine Oxide, Dihydroxyethyl Tallowamine Oxide, Hydrogenated Palm Kernel Amine Oxide, Hydrogenated Tallowamine Oxide, Hydroxyethyl Hydroxypropyl C12–15 Alkoxypropylamine Oxide, Isostearamidopropylamine Oxide, Isostearamidopropyl Morpholine Oxide, Lauramidopropylamine Oxide, Lauramine Oxide, Methyl Morpholine Oxide, Milkamidopropyl Amine Oxide, Minkamidopropylamine Oxide, Myristamidopropylamine Oxide, Myristamine Oxide, Myristyl/Cetyl Amine Oxide, Oleamidopropylamine Oxide, Oleamine Oxide, Olivamidopropylamine Oxide, Palmitamidopropylamine Oxide, Palmitamine Oxide, PEG-3 Lauramine Oxide, Potassium Dihydroxyethyl Cocamine Oxide Phosphate, Potassium Trisphosphonomethylamine Oxide, Sesamidopropylamine Oxide, Soyamidopropylamine Oxide, Stearamidopropylamine Oxide, Stearamine Oxide, Tallowamidopropylamine Oxide, Tallowamine Oxide, Undecylenamidopropylamine Oxide und Wheat Germamidopropylamine Oxide. A preferred amine oxide is, for example, Cocamidopropylamine Oxide (cocoamidopropyl amine oxide).

Sugar Surfactants

Sugar surfactants are known surface-active compounds which include, for example, the sugar surfactant classes of alkyl glucose esters, aldobionamides, gluconamides (sugar acid amides), glycerol amides, glycerol glycolipids, polyhydroxyfatty acid amide sugar surfactants (sugar amides) and alkyl polyglycosides described, for example, in WO 97/00609 (Henkel Corporation) and the publications cited therein (pages 4 to 12) to which reference is made in this regard and of which the disclosure is hereby included in the present application. According to the invention, preferred sugar surfactants are the alkyl polyglycosides and the sugar amides and their derivatives, more particularly their ethers and esters. The ethers are the products of the reaction of one or more, preferably one, sugar hydroxy group with a compound containing one or more hydroxy groups, for example $C_{1-22}$ alcohols or glycols, such as ethylene and/or propylene glycol; the sugar hydroxy group may also carry polyethylene glycol and/or propylene glycol residues. The esters are the reaction products of one or more, preferably one, sugar hydroxy group with a carboxylic acid, more particularly a $C_{6-22}$ fatty acid.

Sugar Amides

Particularly preferred sugar amides correspond to the formula R'C(O)N(R")[Z], where R' is a linear or branched, saturated or unsaturated acyl group, preferably a linear unsaturated acyl group, containing 5 to 21, preferably 5 to 17, more preferably 7 to 15 and most preferably 7 to 13 carbon atoms, R" is a linear or branched, saturated or unsaturated alkyl group, preferably a linear unsaturated alkyl group, containing 6 to 22, preferably 6 to 18, more preferably 8 to 16 and most preferably 8 to 14 carbon atoms, a $C_{1-5}$ alkyl group, more particularly a methyl, ethyl, propyl, isopropyl, n-butyl, isobutyl, tert.butyl or n-pentyl group, or hydrogen and Z is a sugar unit, i.e. a monosaccharide unit. Particularly preferred sugar amides are the amides of glucose, the glucamides, for example lauroyl methyl glucamide.

Alkyl Polyglycosides

The alkyl polyglycosides (APGs) are particularly preferred sugar surfactants for the purposes of the present invention and preferably correspond to the general formula $R^1O(AO)_a[G]_x$, where $R^1$ is a linear or branched, saturated or unsaturated alkyl group containing 6 to 22, preferably 6 to 18 and more preferably 8 to 14 carbon atoms, [G] is a glycosidic sugar unit and x is a number of 1 to 10 and AO stands for an alkyleneoxy group, for example an ethyleneoxy or propyleneoxy group, and a stands for the mean degree of alkoxylation of 0 to 20. The group $(AO)_a$ may also contain various alkyleneoxy units, for example ethyleneoxy or propyleneoxy units, in which case a stands for the mean total degree of alkoxylation, i.e. the sum of the degree of ethoxylation and the degree of propoxylation. Unless indicated in detail or indicated otherwise in the following, the alkyl groups $R^1$ of the APGs are linear unsaturated groups with the indicated number of carbon atoms.

APGs are nonionic surfactants and represent known substances which may be obtained by the relevant methods of preparative organic chemistry. The index x indicates the degree of oligomerization (DP degree), i.e. distribution of mono- and oligoglycosides, and is a number of 1 to 10. Whereas x in a given compound must always be an integer and, above all, may assume a value of 1 to 6, the value x for a certain alkyl oligoglycoside is an analytically determined calculated quantity which is generally a broken number. Alkyl glycosides having an average degree of oligomerization x of 1.1 to 3.0 are preferably used. Alkyl glycosides having a degree of oligomerization of less than 1.7 and, more particularly, between 1.2 and 1.6 are preferred from the applicational point of view. The glycosidic sugar used is preferably xylose but especially glucose.

The alkyl or alkenyl radical $R^1$ may be derived from primary alcohols containing 8 to 18 and preferably 8 to 14 carbon atoms. Typical examples are caproic alcohol, caprylic alcohol, capric alcohol and undecyl alcohol and the technical mixtures thereof obtained, for example, in the hydrogenation of technical fatty acid methyl esters or in the hydrogenation of aldehydes from Roelen's oxosynthesis.

However, the alkyl or alkenyl radical $R^1$ is preferably derived from lauryl alcohol, myristyl alcohol, cetyl alcohol, palmitoleyl alcohol, stearyl alcohol, isostearyl alcohol or oleyl alcohol and may also be derived from elaidyl alcohol, petroselinyl alcohol, arachyl alcohol, gadoleyl alcohol, behenyl alcohol, erucyl alcohol and technical mixtures thereof.

Particularly preferred APGs are not alkoxylated (a=0) and correspond to the formula $RO[G]_x$, in which R again stands for a linear or branched, saturated or unsaturated alkyl group containing 4 to 22 carbon atoms, [G] is a glycosidic sugar, preferably glucose, and x is a number of 1 to 10, preferably 1.1 to 3 and more preferably 1.2 to 1.6. Accordingly, preferred alkyl polyglycosides are, for example, $C_{8-10}$ and a $C_{12-14}$ alkyl polyglucoside with a DP degree of 1.4 or 1.5, more particularly $C_{8-10}$ alkyl-1,5-glucoside and $C_{12-14}$ alkyl-1,4-glucoside.

Cationic Surfactants

The composition according to the invention may additionally contain one or more cationic surfactants (cationic surfactants; INCI Quaternary Ammonium Compounds) in a quantity of—typically—0.001 to 5% by weight, preferably 0.01 to 4% by weight, more preferably 0.1 to 3% by weight, most preferably 0.2 to 2% by weight and, in one most particularly preferred embodiment, 0.5 to 1.5% by weight, for example 1% by weight.

Preferred cationic surfactants are the quaternary surface-active compounds, more particularly containing an ammonium, sulfonium, phosphonium, iodonium or arsonium group, which are described as antimicrobial agents, for example, in K. H. Walhäuβer's "Praxis der Sterilisation, Desinfektion—Konservierung: Keimidentifizierung—Betriebshygiene" (5th Edition, Stuttgart/New York: Thieme, 1995). By using antimicrobial quaternary ammonium compounds, the composition can be given an antimicrobial effect or any antimicrobial activity already present through other ingredients can be improved.

Particularly preferred cationic surfactants are quaternary ammonium compounds (QUATS; INCI Quaternary Ammonium Compounds) corresponding to the general formula $(R^I)(R^{II})(R^{III})(R^{IV})N^+ X^-$, in which $R^I$ to $R^{IV}$ may be the same or different and represent $C_{1-22}$ alkyl groups, $C_{7-28}$ aralkyl groups or heterocyclic groups, two or—in the case of an aromatic compound, such as pyridine—even three groups together with the nitrogen atom forming the heterocycle, for example a pyridinium or imidazolinium compound, and $X^-$ represents halide ions, sulfate ions, hydroxide ions or similar anions. In the interests of optimal antimicrobial activity, at least one of the substituents preferably has a chain length of 8 to 18 and, more preferably, 12 to 16 carbon atoms.

QUATS can be obtained by reaction of tertiary amines with alkylating agents such as, for example, methyl chloride, benzyl chloride, dimethyl sulfate, dodecyl bromide and also ethylene oxide. The alkylation of tertiary amines with one long alkyl chain and two methyl groups is particularly simple. The quaternization of tertiary amines containing two long chains and one methyl group can also be carried out under mild conditions using methyl chloride. Amines containing three long alkyl chains or hydroxy-substituted alkyl chains lack reactivity and are preferably quaternized with dimethyl sulfate.

Suitable QUATS are, for example, benzalkonium chloride (N-alkyl-N,N-dimethylbenzyl ammonium chloride, CAS No. 8001-54-5), benzalkon B (m,p-dichlorobenzyl dimethyl-$C_{12}$-alkyl ammonium chloride, CAS No. 58390-78-6), benzoxonium chloride (benzyldodecyl-bis-(2-hydroxyethyl)-ammonium chloride), cetrimonium bromide (N-hexadecyl-N,N-trimethyl ammonium bromide, CAS No. 57-09-0), benzetonium chloride (N,N-di-methyl-N-[2-[2-[p-(1,1,3,3-tetramethylbutyl)-phenoxy]-ethoxy]-ethyl]-benzyl ammonium chloride, CAS No. 121-54-0), dialkyl dimethyl ammonium chlorides, such as di-n-decyldimethyl ammonium chloride (CAS No. 7173-51-5-5), didecyldimethyl ammonium bromide (CAS No. 2390-68-3), dioctyl dimethyl ammonium chloride, 1-cetylpyridinium chloride (CAS No. 123-03-5) and thiazoline iodide (CAS No. 15764-48-1) and mixtures thereof. Particularly preferred QUATS are the benzalkonium chlorides containing $C_{8-18}$ alkyl groups, more particularly $C_{12-14}$ alkyl benzyl dimethyl ammonium chloride. A particularly preferred QUAT is cocopentaethoxy methyl ammonium methosulfate (INCI PEG-5 Cocomonium Methosulfate; Rewoquat® CPEM).

To avoid possible incompatibilities of the antimicrobial cationic surfactants with the anionic surfactants present in accordance with the invention, the cationic surfactant used should be compatible with anionic surfactants or should only be used in very small amounts. In one particular embodiment of the invention, no antimicrobial cationic surfactants are used at all. Parabens, benzoic acid and/or benzoate, lactic acid and/or lactates may be used as antimicrobial substances. Benzoic acid and/or lactic acid are particularly preferred Solvents The water content of the water-based composition according to the invention is normally 20 to 99% by weight, preferably 40 to 90% by weight, more preferably 50 to 85% by weight and most preferably 55 to 80% by weight.

The composition according to the invention may advantageously contain one or more water-soluble organic solvents in a quantity of—typically—0.1 to 30% by weight, preferably 1 to 20% by weight, more preferably 2 to 15% by weight, most preferably 4 to 12% by weight and, in one most particularly preferred embodiment, 6 to 10% by weight.

In the context of the teaching according to the invention, the solvent is used in particular as a hydrotropic agent, a viscosity adjuster and/or low-temperature stabilizer according to requirements. It has a solubilizing effect, particularly on surfactants and electrolytes, perfumes and dyes, and thus contributes to their incorporation, prevents the formation of liquid crystalline phases and contributes to the formation of clear products. The viscosity of the composition according to the invention decreases with increasing solvent content. However, too much solvent can produce a fall in viscosity. Finally, the cold cloud and clear point of the composition according to the invention decreases with increasing solvent content.

Suitable solvents are, for example, saturated or unsaturated, preferably saturated, branched or unbranched $C_{1-20}$ hydrocarbons, preferably $C_{2-15}$ hydrocarbons, containing at least one hydroxy group and optionally one or more ether functions C—O—C, i.e. oxygen atoms interrupting the carbon atom chain.

Preferred solvents are the $C_{2-6}$ alkylene glycols and poly-$C_{2-3}$-alkylene glycol ethers—optionally etherified on one side with a $C_{1-6}$ alkanol—containing on average 1 to 9 identical or different, preferably identical, alkylene glycol groups per molecule and the $C_{1-6}$ alcohols, preferably ethanol, n-propanol or isopropanol, more particularly ethanol.

Examples of solvents are the following compounds identified by their INCI names: Alcohol (Ethanol), Buteth-3, Butoxydiglycol, Butoxyethanol, Butoxyisopropanol, Butoxypropanol, n-Butyl Alcohol, t-Butyl Alcohol, Butylene Glycol, Butyloctanol, Diethylene Glycol, Dimethoxydiglycol, Dimethyl Ether, Dipropylene Glycol, Ethoxydiglycol, Ethoxyethanol, Ethyl Hexanediol, Glycol, Hexanediol, 1,2,6-Hexanetriol, Hexyl Alcohol, Hexylene Glycol, Isobutoxypropanol, Isopentyldiol, Isopropyl Alcohol (isoPropanol), 3-Methoxybutanol, Methoxydiglycol, Methoxyethanol, Methoxyisopropanol, Methoxymethylbutanol, Methoxy PEG-10, Methylal, Methyl Alcohol, Methyl Hexyl Ether, Methylpropanediol, Neopentyl Glycol, PEG-4, PEG-6, PEG-7, PEG-8, PEG-9, PEG-6 Methyl Ether, Pentylene Glycol, PPG-7, PPG-2-Buteth-3, PPG-2 Butyl Ether, PPG-3 Butyl Ether, PPG-2 Methyl Ether, PPG-3 Methyl Ether, PPG-2 Propyl Ether, Propanediol, Propyl Alcohol (n-Propanol), Propylene Glycol, Propylene Glycol Butyl Ether, Propylene Glycol Propyl Ether, Tetrahydrofurfuryl Alcohol, Trimethylhexanol.

Particularly preferred solvents are the poly-$C_{2-3}$-alkylene glycol ethers etherified on one side with a $C_{1-6}$ alkanol and containing on average 1 to 9 and preferably 2 to 3 ethylene or propylene glycol groups, for example PPG-2 Methyl Ether (dipropylene glycol monomethyl ether).

Most particularly preferred solvents are the $C_{2-3}$ alcohols ethanol, n-propanol and/or isopropanol, more particularly ethanol.

Besides the solvents described above, suitable solubilizers, particularly for perfume and dyes, are, for example, alkanolamines and alkyl benzene sulfonates containing 1 to 3 carbon atoms in the alkyl chain.

Additives

Besides the quaternary ammonium compounds of formula I added in accordance with the invention, the composition according to the invention may contain one or more additives from the group of surfactants, polymers and builders in a quantity of—typically—0.001 to 5% by weight, preferably 0.01 to 4% by weight, more preferably 0.1 to 3% by weight, most preferably 0.2 to 2% by weight and, in one most particularly preferred embodiment, 0.5 to 1.5% by weight, for example 1% by weight in order to further improve its drainage and/or drying behavior.

Surfactants suitable as additives are certain of the above-mentioned amphoteric surfactants, other anionic surfactants, nonionic surfactants and cationic surfactants which are repeated at this point. The content of surface-active additives should preferably be selected so that the total surfactant content lies within the quantity ranges mentioned above.

Some of the additives mentioned in the following are accompanied (in brackets) by one or more trade names under which the particular additive is commercially obtainable.

Amphoteric surfactants suitable as additives are, in particular, sodium carboxyethyl cocophosphoethyl imidazoline (Phosphoteric® TC-6), $C_{8/10}$ amidopropyl betaine (INCI Capryl/Capramidopropyl Betaine; Tego® Betaine 810), N-2-hydroxyethyl-N-carboxymethyl fatty acid amide ethylamine Na (Rewoteric® AMV) and N-caprylic/capric amidoethyl-N-ethylether propionate Na (Rewoteric® AMVSF) and the betaine 3-(3-cocoamidopropyl)-dimethylammonium-2-hydroxypropane sulfonate (INCI Sultaine; Rewoteric® AM CAS) and the alkylamidoalkyl amine N-[N'(N"-2-hydroxyethyl-N"-carboxyethylaminoethyl)-acetic acid amido]-N,N-dimethyl-N-cocoammonium betaine (Rewoteric® QAM 50).

Other anionic surfactants suitable as additives are, in particular, anionic gemini surfactants with a diphenyl oxide basic structure, two sulfonate groups and an alkyl group on one or both benzene rings corresponding to the formula $$^{-}O_3S(C_6H_3R)O(C_6H_3R')SO_3^{-}$$

in which R is an alkyl group containing, for example, 6, 10, 12 or 16 carbon atoms and R' stands for R or H (Dowfax® Dry Hydrotrope Powder containing $C_{16}$ alkyl group(s); INCI Sodium Hexyldiphenyl Ether Sulfonate, Disodium Decyl Phenyl Ether Disulfonate, Disodium Lauryl Phenyl Ether Disulfonate, Disodium Cetyl Phenyl Ether Disulfonate) and the fluorinated anionic surfactants ammonium $C_{9/10}$ perfluoroalkyl sulfonate (Fluorad® FC 120), perfluoro-octane sulfonic acid potassium salt (Fluorad® FC 95) and the sulfosuccinic acid surfactants imidosuccinate, mono-Na-sulfosuccinic acid diisobutyl ester (Monawet® MB 45), mono-Na-sulfosuccinic acid dioctyl ester (Monawet® MO-84 R2W, Rewopol® SB DO 75), mono-Na-sulfosuccinic acid di-tridecyl ester (Monawet® MT 70), fatty alcohol polyglycol sulfosuccinate-Na—$NH_4$ salt (sulfosuccinate, S-2), di-Na-sulfosuccinic acid mono-$C_{12-14}$-3EO ester (Texapon® SB-3), sodium sulfosuccinic acid diisooctyl ester (Texin® DOS 75) and di-Na-sulfosuccinic acid mono-$C_{12/18}$-ester (Texin® 128-P).

Nonionic surfactants suitable as additives are, in particular, $C_{10}$ dimethylamine oxide (Ammonyx® DO), $C_{10/14}$ fatty alcohol+1.2PO+6.4EO (Dehydol® 980), $C_{12/14}$ fatty alcohol+6EO (Dehydol® LS6), $C_8$ fatty alcohol+1.2PO+9EO (Dehydol® O10), $C_{16/20}$ Guerbet alcohol+8EO, n-butyl-end-capped (Dehypon® G2084), a mixture of several n-butyl-end-capped nonionic surfactants and $C_{8/10}$ APG (Dehypon® Ke 2555), $C_{8/10}$ fatty alcohol+1 PO+22EO (2-hydroxydecyl)-ether (Dehypon® Ke 3447), $C_{12/14}$ fatty alcohol+5EO+4PO (Dehypon® LS 54 G), $C_{12/14}$ fatty alcohol+5EO+3PO, methyl-end-capped (Dehypon® LS 531), $C_{12/14}$ fatty alcohol+10EO, n-butyl-end-capped (Dehypon® LS 104 L), $C_{11}$ oxoalcohol+8EO (Genapol® UD 088), $C_{13}$ oxoalcohol+8EO (Genapol® X 089), $C_{13/15}$ fatty alcohol-EO-adduct, n-butyl-end-capped (Plurafac® LF 221) and alkoxylated fatty alcohol (Tegotens® EC-11).

Cationic surfactants suitable as additives are, in particular, cationic surfactants compatible with anionic surfactants, such as quaternary ammonium compounds, for example cocopentaethoxymethyl ammonium methosulfate (INCI PEG-5 Cocomonium Methosulfate; Rewoquat® CPEM).

Polymers suitable as additives are, in particular, maleic acid/acrylic acid copolymer Na salt (Sokalan® CP 5), modified polyacrylic acid Na salt (Sokalan® CP 10), modified polycarboxylate Na salt (Sokalan® HP 25), polyalkylene oxide, modified heptamethyl trisiloxane (Silwet® L-77), polyalkylene oxide, modified heptamethyl trisiloxane (Silwet® L-7608), polyether siloxanes (copolymers of polymethyl siloxanes with ethylene oxide/propylene oxide segments (polyether blocks), preferably water-soluble linear polyether siloxanes with terminal polyether blocks, such as Tegopren® 5840, Tegopren® 5843, Tegopren® 5847, Tegopren® 5851, Tegopren® 5863 and Tegopren® 5878).

Builders suitable as additives are, in particular, polyaspartic acid Na salt, ethylene diamine triacetate cocoalkyl acetamide (Rewopol® CHT 12), methyl glycine diacetic acid tri-Na-salt (Trilon® ES 9964) and acetophosphonic acid (Turpinal® SL).

Mixtures with surface-active or polymeric additives show synergisms in the case of Monawet® MO-84 R2W, Tegopren® 5843 and Tegopren® 5863. However, the use of the Tegopren types 5843 and 5863 is not advised where the compositions according to the invention are used on hard surfaces of glass, particularly glass tableware, because these silicone surfactants can be absorbed onto glass.

In one particular embodiment of the invention, the additives mentioned are not used at all.

Viscosity

The viscosity favorable for the composition according to the invention (at 20° C. and at a shear rate of 30 $s^{-1}$, as measured with a Brookfield LV DV II viscosimeter, spindle 25) is in the range from 10 to 5,000 mPa.s, preferably in the range from 50 to 2,000 mPa.s, more preferably in the range from 100 to 1,000 mPa·s, most preferably in the range from 150 to 700 mPa·s and, in one most particularly preferred embodiment, in the range from 200 to 500 mPa·s, for example 300 to 400 mPa·s.

To this end, the viscosity of the composition according to the invention can be increased by thickeners, particularly where the composition has a low surfactant content, and/or reduced by solvents, particularly where the composition has a high surfactant content.

Thickeners

For thickening, the composition according to the invention may additionally contain one or more electrolyte salts and/or one or more polymeric thickeners.

Electrolyte Salts

Electrolyte salts in the context of the present invention are salts which break up into their ionic constituents in the water-based composition according to the invention.

Preferred salts are the salts, more particularly alkali metal and/or alkaline earth metal salts, of an inorganic acid, preferably an inorganic acid from the group consisting of the hydrohalic acids, nitric acid and sulfuric acid, more particularly the chlorides and sulfates.

A particularly preferred electrolyte salt is magnesium sulfate, more particularly the $MgSO_4 \cdot 7H_2O$ also known as Epsom salt and occurring as the mineral epsomite.

According to the invention, an electrolyte salt may also be used in the form of its corresponding acid/base pair, for example hydrochloric acid and sodium hydroxide instead of sodium chloride.

The electrolyte salt content is normally not more than 8% by weight, preferably between 0.1 and 6% by weight, more preferably between 0.2 and 4% by weight, most preferably between 0.3 and 2% by weight and, in one most particularly preferred embodiment, between 0.5 and 1% by weight, for example 0.7% by weight.

Polymeric Thickeners

Polymeric thickeners in the context of the present invention are the polycarboxylates with a thickening effect as polyelectrolytes, preferably homopolymers and copolymers of acrylic acid, more particularly acrylic acid copolymers, such as acrylic acid/methacrylic acid copolymers, and the polysaccharides, more particularly heteropolysaccharides, and other typical thickening polymers.

Suitable polysaccharides and heteropolysaccharides are the polysaccharide gums, for example gum arabic, agar, alginates, carrageens and salts thereof, guar, guaran, tragacanth, gellan, ramsan, dextran or xanthan and derivatives thereof, for example propoxylated guar, and mixtures thereof. Other polysaccharide thickeners, such as starches or cellulose derivatives, may be used alternatively, but preferably additionally to a polysaccharide gum, for example starches of varying origin and starch derivatives, for example hydroxyethyl starch, starch phosphate esters and starch acetates, or carboxymethyl cellulose or its sodium salt, methyl, ethyl, hydroxyethyl, hydroxypropyl, hydroxypropyl methyl or hydroxyethyl methyl cellulose or cellulose acetate.

A particularly preferred polymeric thickener is the microbial anionic heteropolysaccharide xanthan gum which is produced by Xanthomonas campestris and a few other species under aerobic conditions and which has a molecular weight of 2 to $15 \times 10^6$. This polymer is obtainable from Kelco, for example, under the name of Keltrol®, for example as the cream-colored powder Keltrol® T (transparent) or the white granules Keltrol® RD (readily dispersible).

Acrylic acid polymers suitable as polymeric thickeners are, for example, the high molecular weight homopolymers of acrylic acid crosslinked with a polyalkenyl polyether, more particularly an allyl ether of sucrose, pentaerythritol or propylene (INCI Carbomer), which are also known as carboxyvinyl polymers. Polyacrylic acids such as these are obtainable inter alia from B. F. Goodrich under the name of Carbopol®, for example Carbopol® 940 (molecular weight ca. 4,000,000), Carbopol® 941 (molecular weight ca. 1,250,000) or Carbopol® 934 (molecular weight ca. 3,000,000).

However, particularly suitable polymeric thickeners are the following acrylic acid copolymers: (i) copolymers of two or more monomers from the group of acrylic acid, methacrylic acid and their simple esters preferably formed with $C_{1-4}$ alkanols (INCI Acrylates Copolymer), which include for example the copolymers of methacrylic acid, butyl acrylate and methyl methacrylate (CAS 250235-69-2) or of butyl acrylate and methyl methacrylate (CAS 25852-37-3) and which are obtainable, for example, from Rohm & Haas under the names of Aculyn® and Acusol®, for example the anionic non-associative polymers Aculyn® 33 (crosslinked), Acusol® 810 and Acusol® 830 (CAS 25852-37-3); (ii) crosslinked high molecular weight acrylic acid copolymers which include, for example, the copolymers of $C_{10-30}$ alkyl acrylates—crosslinked with an allyl ether of sucrose or pentaerythritol—with one or more monomers from the group of acrylic acid, methacrylic acid and their simple esters preferably formed with $C_{1-4}$ alkanols (INCI Acrylates/C10–30 Alkyl Acrylate Crosspolymer) and which are obtainable, for example, from B. F Goodrich under the name of Carbopol®, for example the hydrophobicized Carbopol® ETD 2623 and Carbopol® 1382 (INCI Acrylates/C10–30 Alkyl Acrylate Crosspolymer) and Carbopol® AQUA 30 (formerly Carbopol® EX 473).

The polymeric thickener content is normally not more than 8% by weight, preferably between 0.1 and 7% by weight, more preferably between 0.5 and 6% by weight, most preferably between 1 and 5% by weight and, in one most particularly preferred embodiment, between 1.5 and 4% by weight, for example between 2 and 2.5% by weight.

In one preferred embodiment of the invention, however, the composition is free from polymeric thickeners.

Dicarboxylic Acid (Salts)

In order to stabilize the composition according to the invention, particularly where it has a high surfactant content, one or more dicarboxylic acids and/or salts thereof, more particularly a composition of Na salts of adipic acid, succinic acid and glutaric acid commercially obtainable, for example, as Sokalar® DSC, may be added, advantageously in quantities of 0.1 to 8% by weight, preferably in quantities of 0.5 to 7% by weight, more preferably in quantities of 1.3 to 6% by weight and most preferably in quantities of 2 to 4% by weight.

A change in the content of dicarboxylic acid (salt), more particularly in quantities above 2% by weight, can contribute to a clear solution of the ingredients. The viscosity of the mixture can also be influenced within certain limits by this component. In addition, this component influences the solubility of the mixture. In a particularly preferred embodiment, the component in question is used where the surfactant content is high, more particularly above 30% by weight.

However, if their presence is not essential, the composition according to the invention is preferably free from dicarboxylic acids (salts).

Auxiliaries and Additives

In addition, one or more other typical auxiliaries and additives, particularly in manual dishwashing detergents and cleaners for hard surfaces, more particularly UV stabilizers, perfume, pearlizers (INCI Opacifying Agents; for example glycol distearate, for example Cutina® AGS of Henkel KGaA or mixtures containing it, for example the Euperlans® of Henkel KGaA), SRPs (soil repellent polymers), PEG terephthalates, dyes, bleaching agents (for example hydrogen peroxide), corrosion inhibitors, preservatives (for example the technical 2-bromo-2-nitropropane-1,3-diol also known as Bronopol (CAS 52-51-7) which is commercially obtainable as Myacide® BT or as Boots Bronopol B from Boots) and skin-feel-improving or skin-care additives (for example dermatologically active substances, such as vitamin A, vitamin B2, vitamin B12, vitamin C, vitamin E, D-panthenol, sericerin, collagen partial hydrolyzate, various vegetable protein partial hydrolyzates, protein hydrolyzate/fatty acid condensates, liposomes, polypropylene glycol, Nutrilan™, Chitosan™, cholesterol, vegetable and animal oils such as, for example, lecithin, soybean oil, etc., plant extracts such as, for example, aloe vera, azulene, hamamelis extracts, algal extracts, etc., allantoin, AHA complexes), may be present in the compositions according to the invention in quantities of normally not more than 5% by weight. To enhance performance, small quantities of enzymes may be used. Preferred enzymes are proteases (for example BLAP (Henkel), Savinase (NOVO), Durazym (NOVO), Maxapem, etc.), amylases (for example Termamyl (NOVO), etc.), lipases (for example Lipolase (NOVO), etc.), peroxidases, gluconases, cellulases, mannases, etc., for example in quantities of 0.001 to 1.5% and preferably in quantities of less than 0.5%.

pH Value

The pH value of the of the compositions according to the invention may be adjusted with typical pH adjusters, for example acids, such as mineral acids or citric acid, and/or alkalis, such as sodium or potassium hydroxide, a pH in the range from 4 to 9, preferably in the range from 5 to 8 and more particularly in the range from 6 to 7 being preferred, above all where compatibility with the hands is required.

In order to adjust and/or stabilize the pH value, the composition according to the invention may contain one or more buffers (INCI Buffering Agents) in quantities of—typically—0.001 to 5% by weight, preferably 0.005 to 3% by weight, more preferably 0.01 to 2% by weight, most preferably 0.05 to 1% by weight and, in one most particularly preferred embodiment, 0.1 to 0.5% by weight, for example 0.2% by weight. Buffers which are also complexing agents or even chelators (INCI Chelating Agents) are preferred. Particularly preferred buffers are citric acid or the citrates, more particularly the sodium and potassium citrates, for example trisodium citrate $\cdot 2\ H_2O$ and tripotassium citrate$\cdot H_2O$.

Production

The composition according to the invention may be prepared by stirring the individual constituents together in any order. The addition sequence is not crucial to the production of the composition.

Water, surfactants, the quaternary ammonium salts of formula I according to the invention and optionally others of the ingredients mentioned above are preferably stirred together. If perfume and/or dye is/are used, they are subsequently added to the solution obtained. The pH value is then adjusted as described above.

EXAMPLES

Examples of formulations according to the invention are shown in the following Table.

TABLE 1

[a] Hostapur ® SAS 60 (Clariant)

| Composition | E1 | E2 | E3 | E4 | E5 | E6 | E7 | E8 | E9 | E10 | E11 |
|---|---|---|---|---|---|---|---|---|---|---|---|
| Na-$C_{12-14}$-fatty alcohol + 1.3 EO sulfate | 16 | – | – | 32 | – | 10 | 10 | 10 | 10 | 10 | – |
| Na-$C_{12-18}$-fatty alcohol + 2 EO sulfate | – | 5 | 5 | – | 14 | – | – | – | – | – | 22 |
| $C_{12-16}$ FAS | – | – | – | – | – | 20 | 20 | 20 | 20 | 20 | – |
| Na/Mg $C_{12}$ LAS | – | 15 | 15 | – | – | – | – | – | – | – | – |
| Sec. Na/Mg $C_{13-17}$ alkanesulfonate[a] | 8 | – | – | – | – | – | 10 | – | – | – | 11 |
| Cocoamidopropylbetaine | 8 | – | 5 | 7 | 3 | – | – | – | – | – | 11 |
| APG 600 | – | – | – | 2 | 4 | – | – | – | – | – | – |
| Adogen 66 | 2 | 1 | 1 | 2 | 1 | 2 | 1 | 1 | 1 | 1 | 2 |
| $C_{9-13}$ FAEO + 5 EO | – | – | – | – | – | 2.5 | – | 0.5 | – | – | – |
| Dehydol 980 ($C_{10-14}$ FAEO + 1.2 PO + 6.4 P0) | – | – | – | – | – | – | 2 | – | 0.5 | – | – |
| Dehydol LT 7 ($C_{12-18}$ FAEO + 7 EO) | – | – | 2 | – | – | – | – | – | – | – | – |
| Dehydol LSS 5.5 ($C_{12-16}$ FAEO + 5.5 EO) | – | – | – | – | – | – | – | – | – | 0.5 | 5 |
| Dimethylamine oxide | – | – | – | – | – | 7.5 | – | 6 | 6 | 6 | – |
| Na/$NH_4$ cumenesulfonate | – | – | – | – | – | 3 | 3 | 3 | 3 | 3 | – |
| Ethanol, water, perfume, dye, auxiliaries, additives | to 100 | to 100 | to 100 | to 100 | to 100 | to 100 | to 100 | to 100 | to 100 | to 100 | to 100 |

[a] Hostapur ® SAS 60 (Clariant) Tests

Compositions E1 to E11 according to the invention and, for comparison, composition C1 (which does not correspond to the invention) were prepared. The pH was adjusted to a value of about 6.6. Tables 1 and 2 show the respective compositions in % by weight. The commercially available manual dishwashing detergents C2 to C4 of which the analyzed composition in % by weight is shown in Table 2 also served as comparative examples (accordingly, "–" means "analytically not determined" for C2 to C4 whereas "+" stands for "present according to analysis, but not quantitatively determined").

TABLE 2

| Composition | C1 | C2 | C3 | C4 |
|---|---|---|---|---|
| Na $C_{12-14}$-fatty alcohol + 1.3EO sulfate | 10 | 27.5 | – | – |
| Mg $C_{11-14}$ fatty alcohol + 1EO sulfate | – | – | 13 | – |
| Na $C_{11-14}$ fatty alcohol + 1EO sulfate | – | – | 15 | – |
| Na $C_{12-16}$ fatty alcohol + 2EO sulfate | – | – | – | 6.3 |
| Sec. Na $C_{13-17}$ alkane sulfonate[a] | 16 | – | – | 11.6 |
| Cocoamidopropyl betaine | 5 | 2.5 | – | – |
| Dimethyl cocoalkyl ammonium betaine | – | – | 2.2 | – |
| $C_{12-16}$ fatty alcohol-1.4-glucoside | – | 2.5 | – | – |
| N-methyl-$C_{12-16}$-fatty acid glucamide | – | – | 1.3 | – |
| Dimethyl cocoalkylamine oxide | – | – | 1.5 | – |
| $C_{9-13}$ alcohol ethoxylate, aliphatic | – | – | 4.5 | 1 |
| Ethanol | 8 | 8 | 6.5 | – |
| Succinic/glutaric/adipic acid mixture as Na salt | – | 3.3 | – | – |
| Citric acid.$H_2O$ | 0.1 | – | – | – |
| Perfume | 0.45 | + | – | + |
| Water | to 100 | to 100 | to 100 | to 100 |

[a]Hostapur ® SAS 60 (Clariant)

Drying Rate

To test the drying rate, the reduction in weight of glass plates wetted with detergent solution as a function of time was followed for detergents E1 to E11 and C2 to C4.

The temperature of the detergent solution (wash liquor) and of the plates was 20° C., the amount of wash liquor applied per glass plate was at least 0.05 g and the detergent concentration was 0.4 g per liter of wash liquor. First, flat glass plates (internal diameter 16.5 cm) of which the dry weight had been determined beforehand were finely sprayed for 10 seconds with a paper-thin layer of the wash liquor using a compressor-driven airbrush spray nozzle, the plates being held at an angle of 90° to the spray jet. The spraying time of about 10 seconds in which at least 0.05 g of wash liquor is applied to a plate was determined in preliminary tests. The plate was then placed on a balance linked to a computer and the weight of the plate was recorded by the computer every second starting from when the plate was still wetted with 0.05 g of wash liquor, i.e. from a weight 0.05 g above the weight of the dry plate, to complete dryness of the plate, i.e. until the weight of the dry plate was reached. The air humidity was determined by a hygrometer which was placed immediately adjacent the balance and was between 35 and 46% relative air humidity. Six measurements were carried out for each wash liquor.

Comparison of the average values of 6 measurements produces the following result: the drying rate of the SAS-containing formulations (ES-99-157 and Palmolive Ultra) appears to be slightly higher than that of the SAS-free formulations Pril Supra and Fairy Ultra.

The average values of the 6 measurements revealed the following order of decreasing drying rates: E1–E11>C2>C3>C4. Accordingly, the compositions according to the invention had a higher drying rate, i.e. quicker drying or better drying behavior, than the four comparison detergents.

In another test, the detergents to be tested were dissolved to the in-use concentration (2 ml solution/5000 ml water, 16° dH). Black plates were then immersed for ca. 60 s in the warm wash liquor (40° C.) and then quickly withdrawn therefrom. Drying behavior was recorded as a function of time using a digital camera/video camera. The average drying times were ca. 3 mins., the formulations according to the invention drying far more quickly.

Drainage Rate

To test the drainage rate, the reduction in weight of champagne flutes with an outlet which had been filled with detergent solution (wash liquor) and then left to run dry was followed as a function of time for detergents E1 to E11 and C1 to C3.

The filling level of the champagne flutes falls quickly while the drainage of wash liquor to be tested for speed starts above the falling filling level. When the filling level has fallen to the level of the outlet and hence to zero, it is only the drainage of interest here that occurs. Drainage ends when finally the layer of wash liquor on the glass surface has become so thin that it no longer drains off but only reduces by drying.

To this end, a balance was installed in an air-tight plastic box. Through an interface, the reduction in weight was recorded every second for 5 minutes by a computer. In order to determine drainage only, the first 12 seconds were not included in the evaluation. The champagne flutes were filled by pump with the wash liquor heated to 45° C. The concentration was 0.4 g detergent per liter wash liquor. The tubular outlet located in the glass bottom of the champagne flutes had a diameter of 15 mm and carried the outflowing wash liquor away over the balance. Temperature and air humidity were monitored by hygrometer during the measurements. Ten measurements were carried out for each wash liquor.

The average values of 10 measurements revealed the following order of decreasing drainage rates: E1–E11>C2>C3>C1. Accordingly, the two compositions according to the invention showed a higher drainage rate, i.e. faster drainage or better drainage behavior, than the three comparison detergents.

What is claimed is:

1. A method of cleaning a hard surface comprising the steps of providing a composition comprising:

(a) one or more alkyl ether sulfates;

(b) at least one quaternary ammonium compound corresponding to formula I:

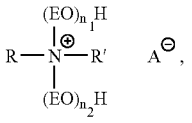

in which EO is ethylene oxide, R and R' are the same or different and represent alkyl groups, $n_1$ is 0–30, $n_2$ is 0–30, and A is a counterion;

(c) 0 to 50% of one or more alkyl and/or aryl sulfonates;

(d) 0 to 15% of one or more alkyl sulfates;

(e) 0.1 to 20% of one or more amphoteric surfactants; and (f) water, wherein the composition has a pH of 6 to 7 and is free of enzymes and magnesium ions and applying a cleaning-effective amount of said composition to the hard surface to effect cleaning thereof, improved rate of drying of the surface and improved rate of drainage of water from the surface.

2. The method of claim 1, wherein the hard surface comprises one or more pieces of tableware.

3. The method of claim 1, wherein the hard surface is selected from the group consisting of glass, ceramic, plastic and metal.

4. The method of claim 1, wherein R is a ($C_{5-26}$) alkyl group and R' is a ($C_{1-10}$) alkyl group.

5. The method of claim 4, wherein R is a ($C_{12-22}$) tallow alkyl group.

6. The method of claim 5, wherein R is a ($C_{16-18}$) tallow alkyl group and R' is ethyl.

7. The method of claim 1, wherein A is a single negative charge anion selected from the group consisting of chloride, bromide, iodide, hydroxide, hydrogen sulfate, hydrogen carbonate, dihydrogen phosphate, thiocyanate, aryl sulfate, ($C_{1-5}$) alkyl sulfate, and mixtures thereof.

8. The method of claim 7, wherein A is a methyl sulfate, ethyl sulfate, or a combination thereof.

9. The method of claim 8, wherein A is ethyl sulfate.

10. The method of claim 1, wherein the composition further comprises one or more water-soluble organic solvents, one or more additives, one or more thickeners, one or more dicarboxylic acid salts, one or more auxiliaries or additives, and mixtures thereof.

11. The method of claim 1, wherein the composition has a viscosity of 10 to 5,000 mPa.s.

12. The method of claim 11, wherein the composition has a viscosity of 100 to 1,000 mPa.s.

13. The method of claim 12, wherein the composition has a viscosity of 150 to 700 mPa.s.

14. The method of claim 13, wherein the composition has a viscosity of 200 to 500 mPa.s.

15. The method of claim 1, wherein the composition further comprises one or more buffer substances.

16. The method of claim 15, wherein the buffer substances are complexing or chelating buffers.

17. The method of claim 16, wherein the buffer substances are citric acid or citrates.

* * * * *